United States Patent [19]

Fujimaki et al.

[11] Patent Number: 4,591,542

[45] Date of Patent: May 27, 1986

[54] LIGHT-SENSITIVE MEMBER AND PREPARATION THEREOF FOR USE IN ELECTROPHOTOGRAPHY

[75] Inventors: Yoshihide Fujimaki; Koichi Kudo; Yoshiaki Takei; Hiroyuki Nomori, all of Hachioji, Japan

[73] Assignee: Konishiroku Photo Industry Co., Ltd., Tokyo, Japan

[21] Appl. No.: 612,373

[22] Filed: May 21, 1984

[30] Foreign Application Priority Data

May 26, 1983 [JP] Japan ..... 58-93053

[51] Int. Cl.[4] ..... G03G 5/14

[52] U.S. Cl. ..... 430/59; 430/83; 430/127

[58] Field of Search ..... 430/59, 58, 73, 76, 430/77, 78, 127, 130

[56] References Cited

U.S. PATENT DOCUMENTS 4,440,845 4/1984 Hashimoto ..... 430/57

4,456,671 6/1984 Mabuchi et al. ..... 430/58

FOREIGN PATENT DOCUMENTS 0040839 4/1981 Japan ..... 430/130

*Primary Examiner*—John L. Goodrow

*Attorney, Agent, or Firm*—Frishauf, Holtz, Goodman & Woodward

[57] ABSTRACT

Disclosed is a light-sensitive member for electrophotography, having a charge generating phase formed by coating a dispersion comprising a charge generating substance, which contains in said charge generating phase an amine in an amount of 20-fold moles or less per mole of said charge generating substance and the solvent. Also disclosed are useful methods for the preparation of such a light-sensitive member.

22 Claims, 5 Drawing Figures

LIGHT-SENSITIVE MEMBER AND PREPARATION THEREOF FOR USE IN ELECTROPHOTOGRAPHY

BACKGROUND OF THE INVENTION

This invention relates to a light-sensitive member (particularly a light-sensitive member for electrophotography) and a method for preparing the same.

Generally speaking, a substance capable of generating a visible light absorbing carrier can be difficult to form into a film. Only a very few substances such as amorphous selenium are suitable, and may have the further drawback having poor retentive force for the charges given to its surface. On the contrary, a substance excellent in film-forming ability and capable of retaining charges of 500 V or higher for a long time with a thickness of about 10 μm has generally the drawback of having no sufficient photoconductivity by absorption of a visible light.

For such reasons, it has been proposed to provide laminate of a carrier generating layer containing a substance capable of generating charged carriers by absorption of a visible light and a carrier transporting layer for transporting either one or both of the positive and negative charged carriers generated in the carrier generating layer and constituted the light-sensitive layer of such a laminate. Thus, by dividing the functions of generation and transportation of the charged carriers to be possessed separately by different substances, the scope for choice of materials can be broadened to improve various characteristics required in electrophotographic process, such as charge retentive force, surface strength, sensitivity to visible light and stability during repeated use.

As a method of preparing such a function-separation type 10. light-sensitive member, there are the method in which the carrier generating layer and the carrier transporting layer are formed by coating by using separate coating solutions, respectively, and the method in which the carrier generating layer is formed by vapor deposition. The carrier generating layer may include the case containing a resin and the case containing no resin, but improvement of sensitivity is desired in either case.

Japanese Unexamined Patent Publication No. 55643/1977 discloses an example in which an amine is used as the solvent for the purpose of enhancing sensitivity of the light-sensitive member. According to this method, dye substances for generation of carriers soluble in an primary organic amine (azo type dye and squaric acid derivative) are dissolved in a solvent containing an organic primary amine, and the resultant solution is applied on an electroconductive substrate to form a carrier generating layer.

Whereas, as a result of the investigation made by the the present inventors on the technique for generating a carrier generating layer with an amine as the solvent as described above, the following defects were found to occur.

That is, because an amine type solvent is used as the coating solvent, the amine content in the coating solvent is required to be enough to dissolve completely the azo type dye, namely in an amount exceeding 20%. For this reason, the drying time after coating is prolonged and the coated product after drying is also inconvenient in handling on account of the sticky surface of the carrier generating layer, etc. Moreover, many organic amines have strong stimulating odors and therefore use of much amount of an amine will worsen the environmental conditions during coating. To be more important, the performance of an azo type dye is determined by its crystalline state, but the azo type dye becomes completely amorphous state because it is coated by dissolving according to such a method as described above, whereby no sufficient performance can be obtained. Also, because a large amount of amine is used by dissolution, the absorption wavelength of the carrier generating layer is shifted toward the shorter wavelength side to result in great lowering in photosensitivity or great lowering in dark decay or acceptive potential during repeated uses of the light-sensitive member.

The present inventor has found that the causes for the problems as mentioned above are too large amount of an amine contained in the carrier generating layer as well as the too high amine concentration in the coating solution, as the result of using a large amount of an amine for dissolving a carrier generating substance in the known technique of the prior art as described above.

SUMMARY OF THE INVENTION

An object of the present invention is to provide a light-sensitive member which can eliminate all of the drawbacks of the prior art as mentioned above by setting an amine concentration within a specific range in the charge generating phase (carrier generating layer).

Another object of the present invention is to provide a method for preparing such a photosensitive member with good reproducibility.

More specifically, the present invention concerns a light-sensitive member having a charge generating phase containing a charge generating substance, which comprises containing an amine in an amount of not more than 20-fold moles or less of said charge generating substance in said charge generating phase.

DETAILED DESCRIPTION OF THE INVENTION

Figure 1:
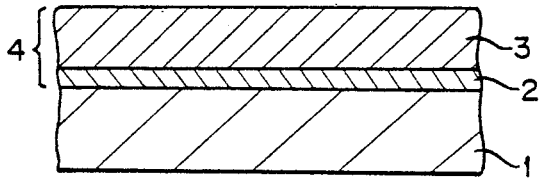
FIG. 1 shows a sectional view of a part of an embodiment of the light-sensitive member of the present invention.

According to this light-sensitive member, since the amine content in the charge generating phase is by far smaller than that in the prior art to be specifically determined as 20-fold or less (desirably 10-fold or less, particularly 5-fold or less) moles per mole of the charge generating substance, the charge generating substance will not substantially be dissolved by the amine during formation of the charge generating phase by coating (that is, the amine does not act as the solvent), but it can be dispersed in a coating solution. As a result, coating under dispersed state can be rendered possible, whereby the crystallinity in the step of synthesis can be stored and no change in absorption spectrum occurs to improve light sensitivity. Besides, lowering in dark decay and acceptive potential during repeated use can also effectively be prevented by the amine content as specified above. Further, because of the small amount of amine, the drying time after coating can be shortened to give no sticky surface and also improve advantageously the environmental maintenance during coating.

Also, by the above amine content according to the present invention, various characteristics such as light sensitivity by amine addition can be improved. This is particularly marked in the case when the charge generating substance has an electron attracting group such as a cyano group in an azo type pigment. Further, within the amine content as specified above, it is possible to effect increase of receiving potential and reduction of dark decay, probably because the amine can be effectively adsorbed on the acceptor site in the charge generating phase, thereby reducing the acceptor concentration to increase the electrical resistance of the charge generating phase.

For the reasons as mentioned above, it is essentially required to control the amine content in the charge generating phase within the moles as specified above.

The above light-sensitive member according to the present invention should desirably be formed by a process having the step of adding an amine in moles of 20-fold or less per mole of the charge generating substance into a solvent for coating of the charge generating phase and dispersing the charge generating substance in the coating solvent, and the step of forming the charge generating phase by coating of the resultant dispersion. In this case, the amount of the amine added is preferred to be very small as 1/200 to 1/2000 vol. % (5 ml to 0.5 ml or less per 1000 ml of the solvent for coating solution). In this case, for example, the charge generating substance may have a molecular weight of 1000, the amine a molecular weight of 80 and the dispersion concentration may be 1.5% by weight.

According to another preparation method of the present invention, there is provided a method for preparation of a light-sensitive member having a charge generating phase (specifically a charge generating layer) and a charge transporting phase (specifically a charge transporting layer) which is in contact with the charge generating layer and contains a charge transporting substance, which comprises having the step of adding an amine in moles of 20-fold or less per mole of the charge generating substance into the coating solvent for the charge transporting layer and dissolving the charge transporting substance in the coating solvent and the step of forming the charge transporting layer by coating. Also, by this method, during coating of the charge transporting layer, a predetermined amount (namely within the moles as specified above) of an amine is permitted to be diffused from the coating solution into the charge generating layer, and the amine can be contained in the charge generating layer in an ammount corresponding to said amount.

Further, according to still another method of the present invention, after coating of the aforesaid charge generating layer, the charge generating layer can be brought into contact with an amine atmosphere for a predetermiend period of time to have the amine diffused and contained in the charge generating layer in moles as specified above.

In the light-sensitive member and the method for preparation thereof, the above amine should desirably have a molecular weight of 150 or less and a basicity ($K_B$) of $10^{-12}$ or more. It is also preferred to use an amine having a boiling point higher than the coating solvent for the charge generating phase or for the charge transporting phase being in contact with the charge generating phase. Further, the drying temperature after coating of the charge generating phase or the charge transporting phase should desirably be made lower than the boiling point of the amine.

In the present invention, the above-mentioned "phase", in addition to the case where a layer is formed, also means the case where both the substances occupy respective regions in a mixture (thereby forming the phases).

According to a preferred embodiment of the present invention, an azo type pigment as the carrier generating substance dipsersed alone or together with a binder resin in a suitable solvent may be coated and dried.

The azo type pigment which can be utilized in the present invention may include mono-azo type, poly-azo type, metal complex azo type, stilbene azo type, thiazole azo type and the like.

The azo type dye which can exhibit marked effect of amine addition may include the compounds including electron attracting groups such as CN, Cl, Br, etc. in the mother nucleus as represented by the formulae [I]-[III] shown below. A marked effect can also be observed by use of a tris-azo type compound represented by the formula [IV] shown below.

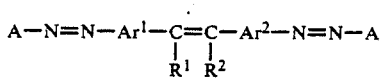

Formula [I]

wherein:

$Ar^1$ and $Ar^2$ each represent a substituted or unsubstituted carbocyclic aromatic ring or a substituted or unsubstituted heterocyclic aromatic ring;

$R^1$ and $R^2$ each represent an electron-attracting group as mentioned above or a hydrogen atom (provided that at least one of $R^1$ and $R^2$ is an electron-attracting group);

A represents:

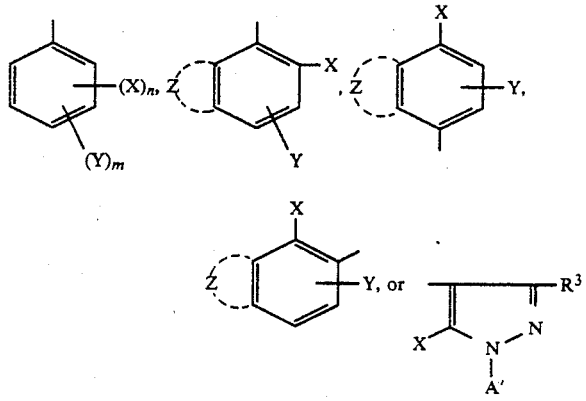

X represents a hydroxy group,

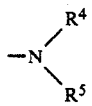

or $—NHSO_2—R^6$ (where each of $R^4$ and $R^5$ is a hydrogen atom or a substituted or unsubstituted alkyl group, $R^6$ is a substituted or unsubstituted alkyl group or a substituted or unsubstituted aryl group);

Z represents a group of atoms necessary for constituting a substituted or unsubstituted carbocyclic aromatic ring or a subtituted or unsubstituted heterocyclic ring;

$R^3$ represents a hydrogen atom, a substituted or unsubstituted amino group, a substituted or unsubstituted carbamoyl group, a carboxyl group or its ester group;

A' represents a substituted or unsubstituted aryl group;

n represents an integer of 1 or 2; and m represents an integer of 0, 1 or 2.

Formula [II]

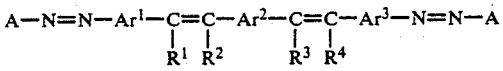

Formula [III]

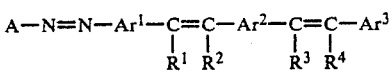

wherein:

$Ar^1$, $Ar^2$ and $Ar^3$ each represent a substituted or unsubstituted aromatic carbon ring residue or a substituted or unsubstituted aromatic heterocyclic ring residue;

$R^1$, $R^2$, $R^3$ and $R^4$ each represent an electron-attracting group as mentioned above or a hydrogen atoms (provided that at lest one of $R^1$, $R^2$, $R^3$ and $R^4$ is an electron-attracting group);

A represents:

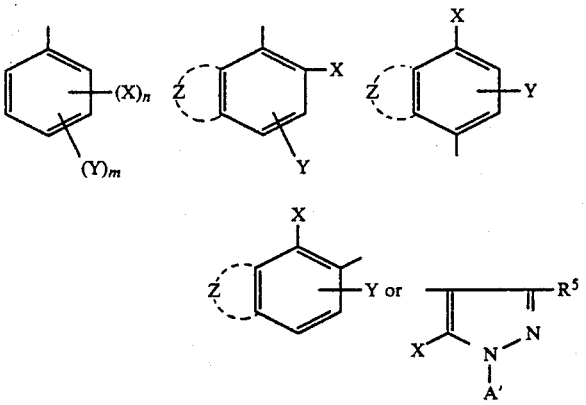

X represents a hydroxy group,

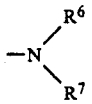

or —$NHSO_2$—$R^8$ (where each of $R^6$ and $R^7$ is a hydrogen atom or a substituted or unsubstituted alkyl group, $R^8$ is a substituted or unsubstituted alkyl group or a substituted or unsubstituted aryl group);

Y represents a halogen atom, a substituted or unsubstituted alkyl group, a substituted or unsubstituted alkoxy group, a carboxyl group, a sulfo group, a substituted or unsubstituted carbamoyl group, or a substituted or unsubstituted sulfamoyl group;

Z represents a group of atoms necessary for constituting substituted or unsubstituted carbocyclic aromatic ring or a substituted or unsubstituted heterocyclic aromatic ring;

$R^5$ represents a hydrogen atom, a substituted or unsubstituted amino group, a substituted or unsubstituted carbamoyl group, a carboxyl group or its ester group;

A' represents a substituted or unsubstituted aryl group;

n represents an integer of 1, 2 or 3; and m represents an integer of 0, 1 or 2.

Formula [IV]:

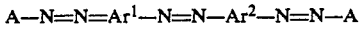

wherein:

$Ar^1$ and $Ar^2$ each represent a substituted or unsubstituted carbocyclic aromatic ring or a substituted or unsubstituted heterocyclic aromatic ring;

A represents:

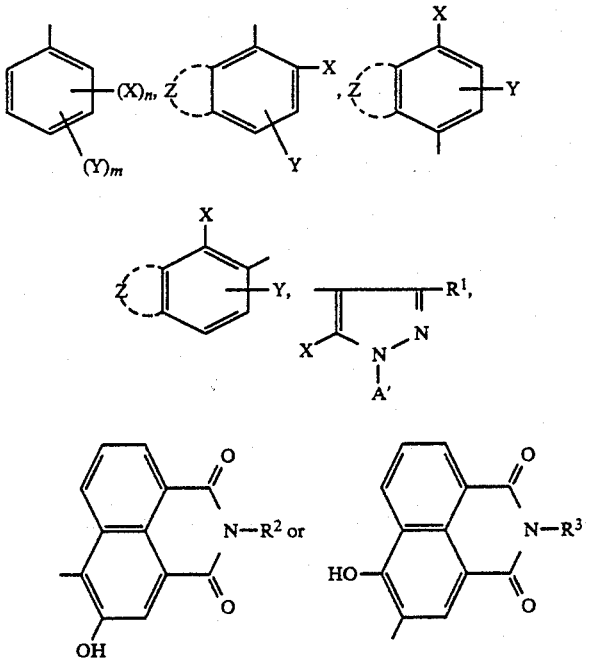

X represents a hydroxy group

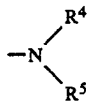

or —$NHSO_2$—$R^6$ (where each of $R^4$ and $R^5$ is a hydrogen atom or a substituted or unsubstituted alkyl group, $R^6$ is a substituted or unsubstituted alkyl group or a substituted or unsubstituted aryl group);

Y represents a halogen atom, a substituted or unsubstituted alkyl group, alkoxy group, carboxyl group, sulfo group, a substituted or unsubstituted carbamoyl group, or a substituted or unsubstituted sulfamoyl group;

Z represents a group of atoms necessary for constituting a substituted or unsubstituted carbocyclic aromatic ring or a subtituted or unsubstituted heterocyclic ring;

A' represents a substituted or unsubstituted aryl group;

$R^1$ represents a hydrogen atom, a substituted or unsubstituted amino group, a substituted or unsubstituted alkyl group, a substituted or unsubstituted carbamoyl group;

$R^2$ and $R^3$ each represent a substituted or unsubstituted alkyl group, a substituted or unsubstituted aralkyl group or a substituted or unsubstituted aryl group;

n represents an integer of 1 or 2; and m represents an integer of 0, 1 or 2.

The amine to be added in a minute amount to a coating solution may comprise primary amines such as monoethanolamine, n-butylamine, ethylenediamine, cyclohexylamine, n-pentylamine, propylamine, isobutylamine, etc.; secondary amines such as diethanolamine, diethylamine, di-n-propylamine, di-n-butylamine, di-n-pentylamine, di-iso-propylamine, etc.; tertiary amines such as triethanolamine, triethylamine, tributylamine etc.; and heterocyclic amines such as pyridine, piperidine, etc.

The dispersing medium for an azo type dye may include N,N-dimethylformamide, acetone, methyl ethyi ketone, cyclohexanone, benzene, toluene, xylene, chloroform, 1,2-dichloroethane, dichloromethane, tetrahydrofuran, dioxane, methanol, ethanol, isopropanol, ethyl acetate, butyl acetate, dimethyl sulfoxide and so on.

The binder resin may include addition polymerization type resins, polyaddition type resins and polycondensation type resins such as polyethylene, polypropylene, acrylic resins, methacrylic resins, vinyl chloride resins, vinyl acetate resins, epoxy resins, polyurethane resins, phenol resins, polyester resins, alkyd resins, polycarbonate resins, silicone resins, melamine resins, etc. and copolymer resins containing two or more units of these resins, for example, insulating resins such as vinyl chloride-vinyl acetate copolymer resins, vinyl chloride-vinyl acetate-maleic anhydride copolymer resins, and also polymeric organic semiconductors such as poly-N-vinylcarbazole and others. And, the proportion of the binder resin to the azo type pigment may desirably be 0 to 100% by weight, particularly 0 to 10% by weight.

FIG. 1 illustrates a partial view of a light-sensitive member, comprising a carrier generating layer 2 as described above formed on an electroconductive support 1 and further a carrier transportting layer 3 formed on it.

Figure 2A:
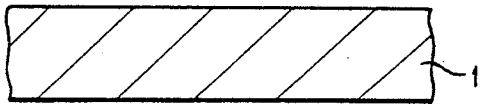
FIG. 2A shows a sectional view of the electroconductive support.
Figure 2B:
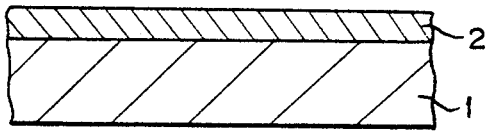
FIG. 2B shows a sectional view of the state where a charge generating layer is formed.

For preparation of this light-sensitive member, first an electroconductive substrate 1 is prepared as shown in FIG. 2A, and then a coating solution containing a carrier generating substance dispersed in a solvent containing a minute amount of an amine (20 mole or less of an azo type pigment) is applied on the substrate 1 and dried to form the carrier generating layer 2 as shown in FIG. 2B. Subsequently, a coating solution containing a carrier transporting substance is applied on the carrier generating layer 2 and dried to form a carrier transporting layer shown in FIG. 1.

The carrier generating layer should have a thickness preferably of 0.05 to 10 μm, more preferably 0.05 μm to 5 μm. With a thickness less than 0.05 μm or over 10 μm, no sufficient light sensitivity can be obtained.

The carrier transporting substance to be used in present invention may be a substance which can transmit sufficiently the light for generating charges in the carrier generating layer on irradiation of light and can also retain the desired charged potential on charging to positive or negative polarity. Examples of such substances are styryl compounds, hydrazone compounds, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, pyrazoline derivatives, oxazolone derivatives, benzothiazole derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene, 2,4,7-trinitrofluorenone, 2,4,5,7-tetra-nitrofluorenone, 2,7-dinitrofluorenone, those compounds which are shown by the formulas A-1 to A-128, and the like.

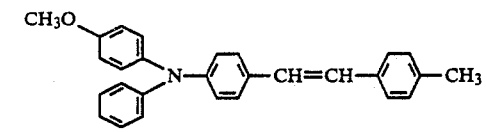
A-1

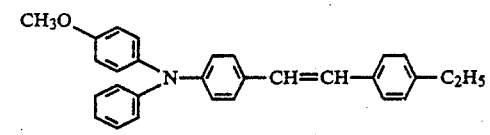
A-2

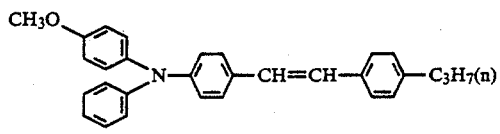
A-3

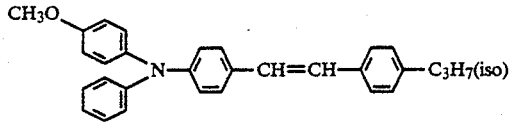
A-4

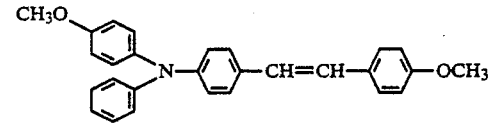
A-5

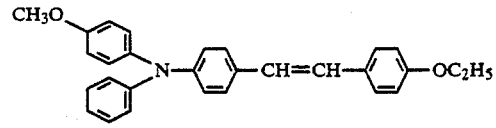
A-6

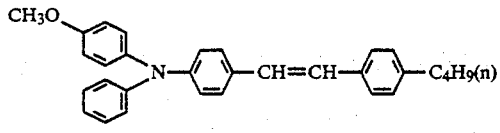
A-7

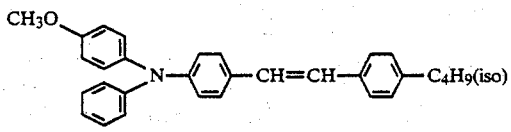
A-8

-continued
A-9
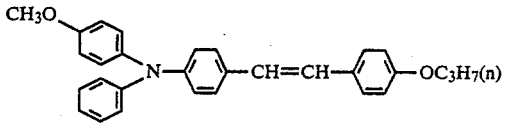
A-10
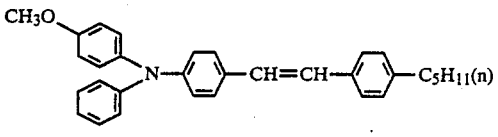
A-11
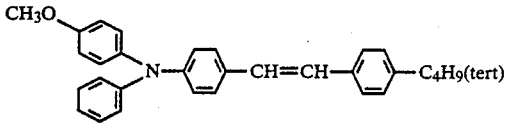
A-12
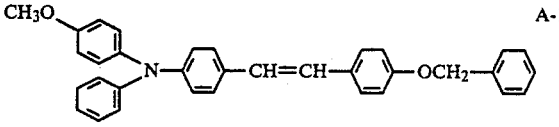
A-13
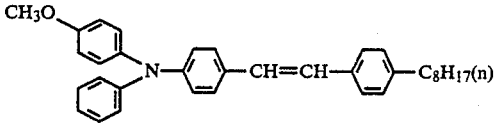
A-14
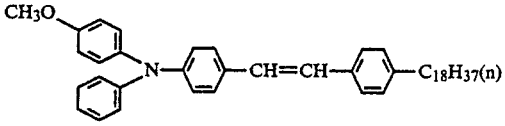
A-15
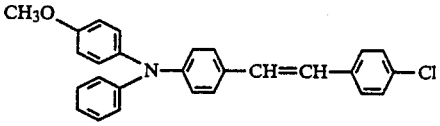
A-16
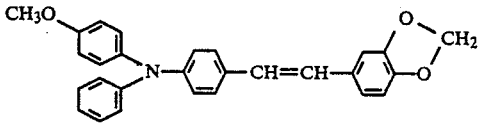
A-17
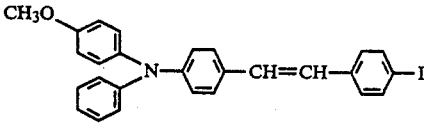
A-18
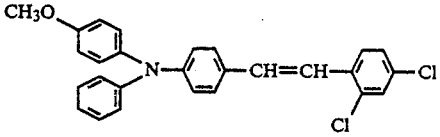
A-19
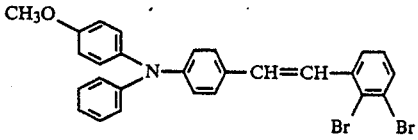
A-20
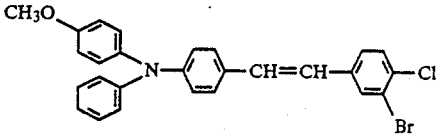
-continued
A-21
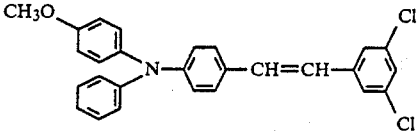
A-22
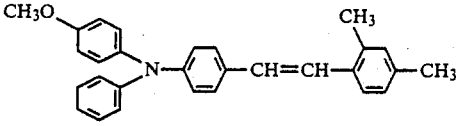
A-23
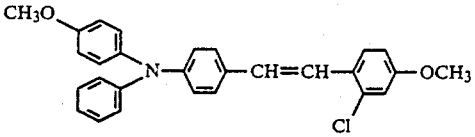
A-24
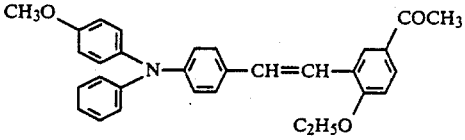
A-25
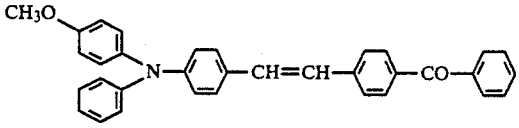
A-26
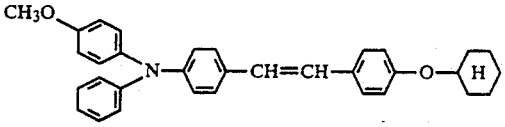
A-27
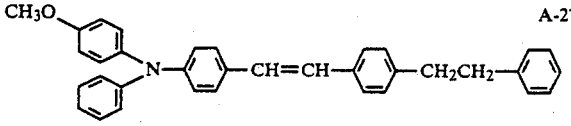
A-28
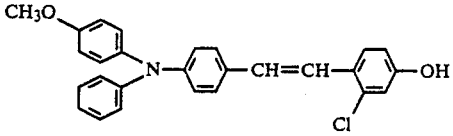
A-29
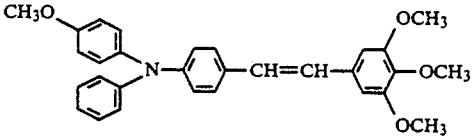
A-30
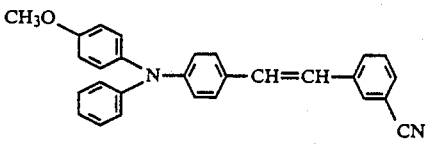
A-31
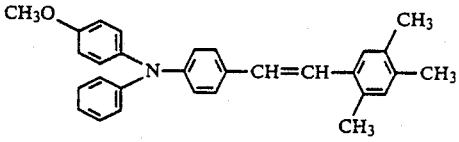
A-32
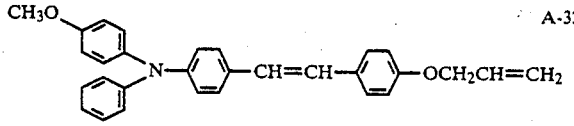

-continued
A-33
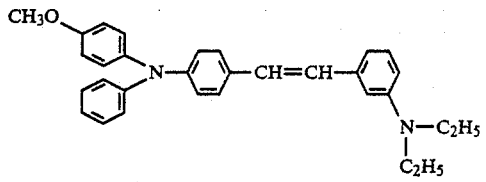
A-34
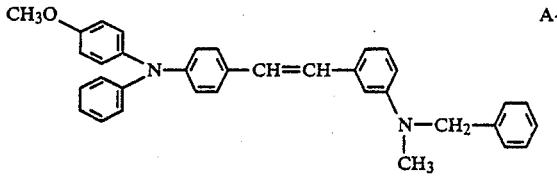
A-35
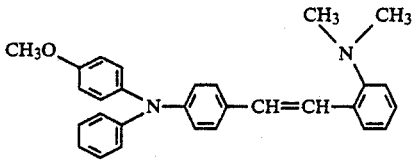
A-36
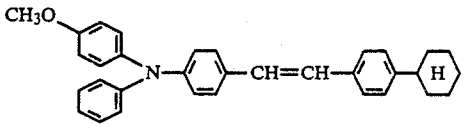
A-37
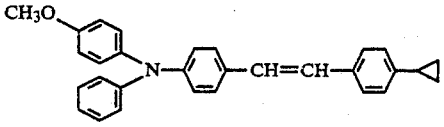
A-38
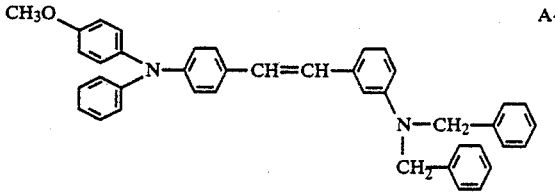
A-39
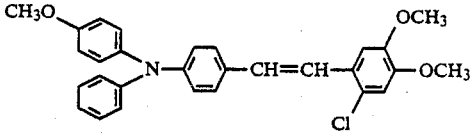
A-40
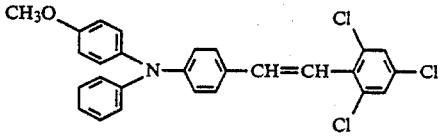
A-41
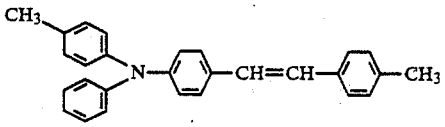
A-42
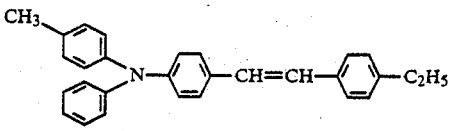
-continued
A-43
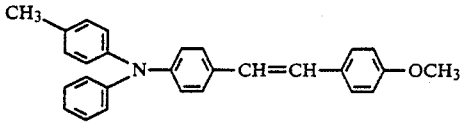
A-44
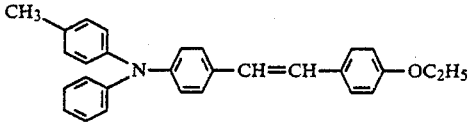
A-45
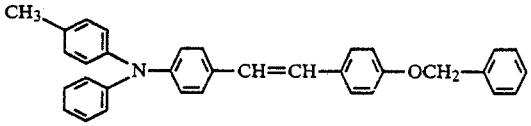
A-46
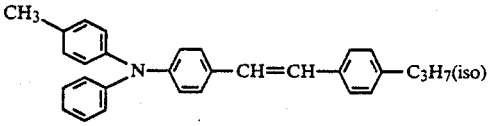
A-47
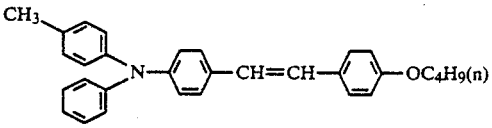
A-48
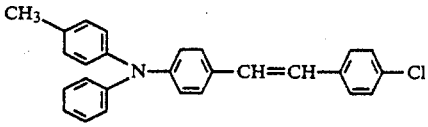
A-49
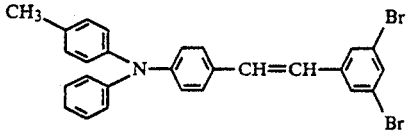
A-50
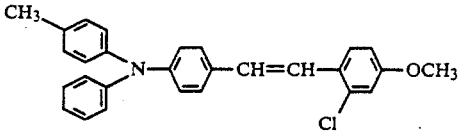
A-51
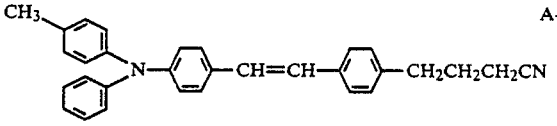
A-52
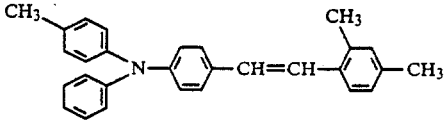
A-53
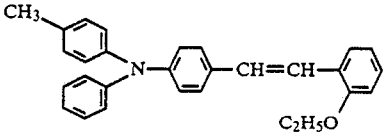
A-54
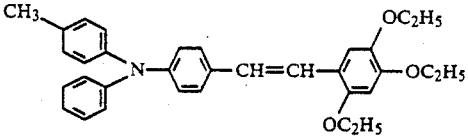

-continued
A-55
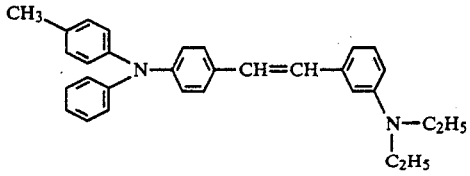
A-56
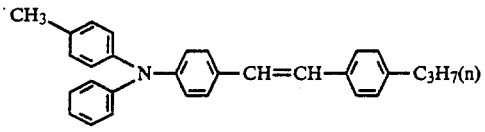
A-57
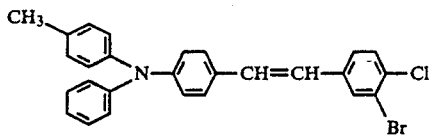
A-58
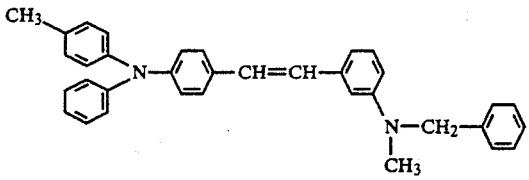
A-59
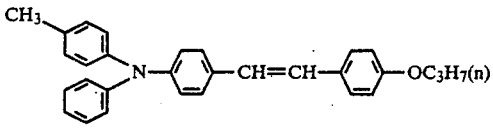
A-60
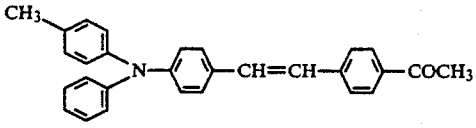
A-61
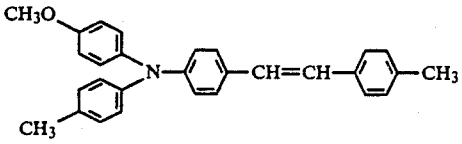
A-62
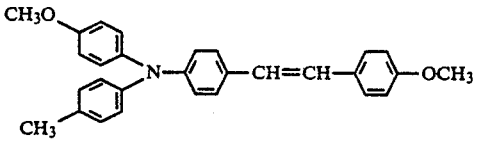
A-63
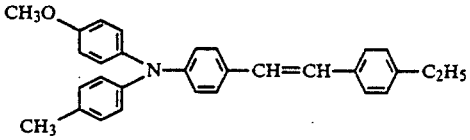
A-64
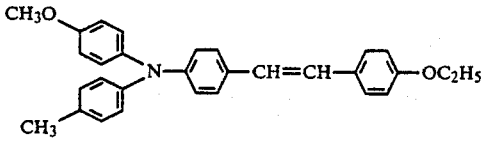
A-65
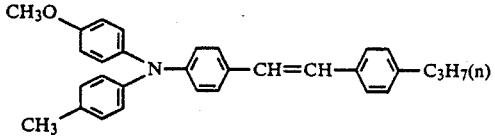
-continued
A-66
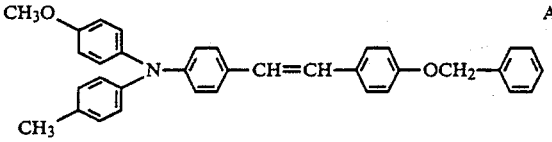
A-67
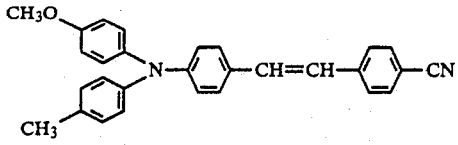
A-68
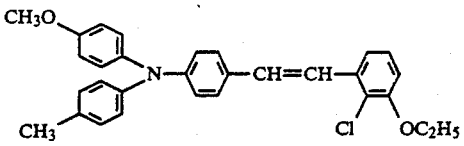
A-69
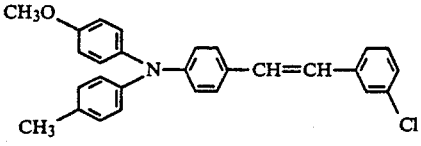
A-70
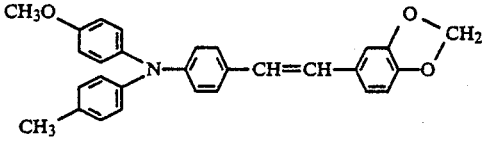
A-71
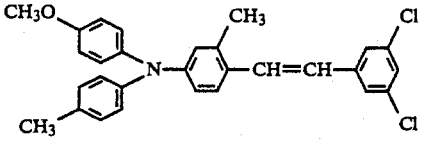
A-72
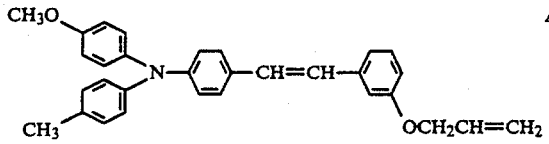
A-73
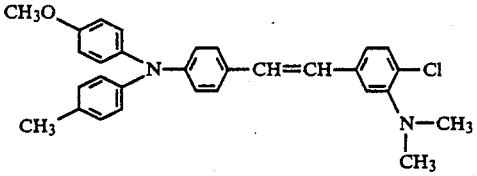
A-74
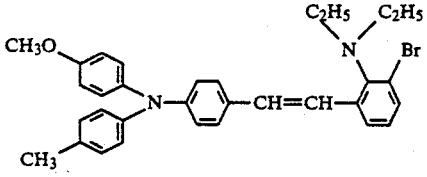
A-75
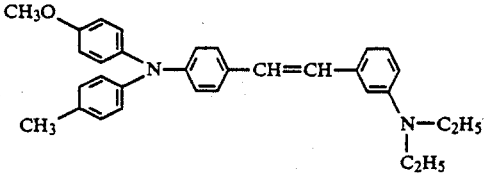

-continued
A-76
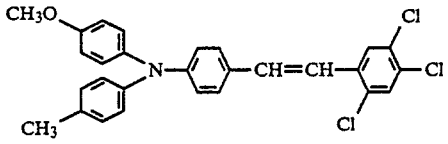
A-77
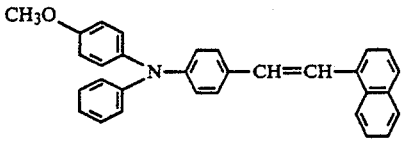
A-78
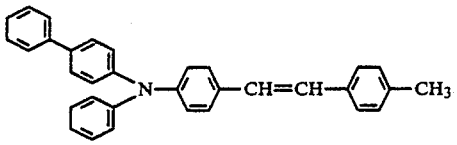
A-79
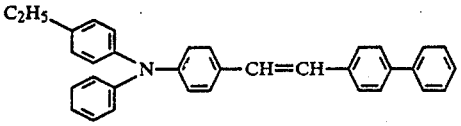
A-80
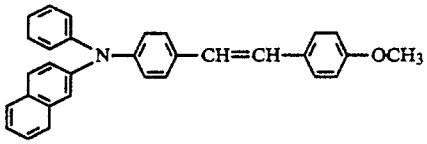
A-81
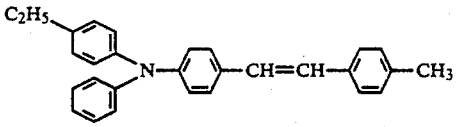
A-82
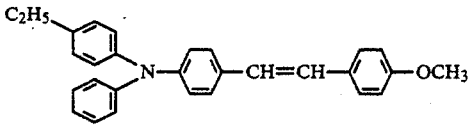
A-83
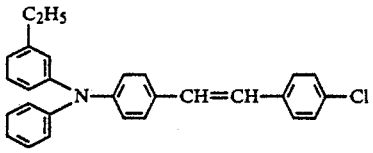
A-84
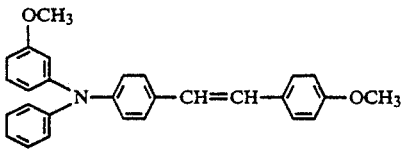
A-85
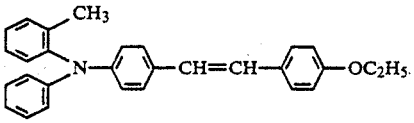
A-86
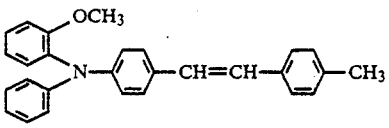
-continued
A-87
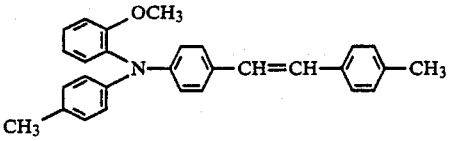
A-88
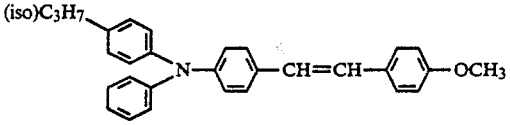
A-89
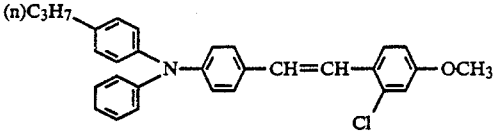
A-90
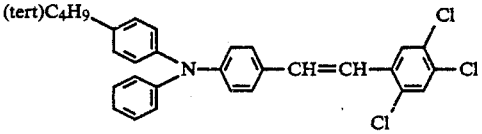
A-91
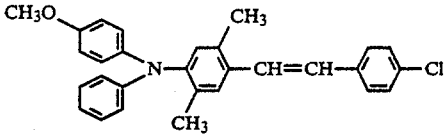
A-92
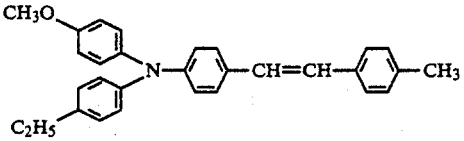
A-93
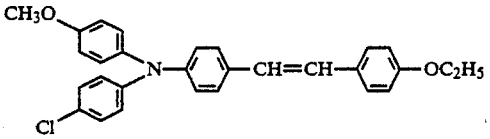
A-94
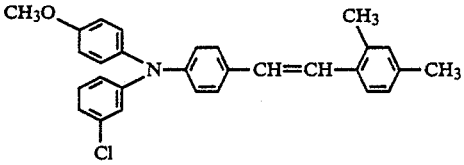
A-95
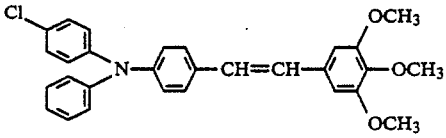
A-96
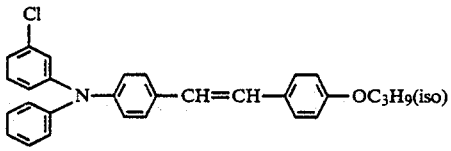
A-97
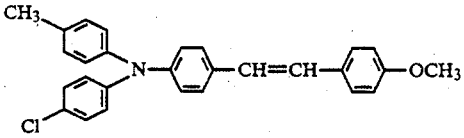

-continued
A-98
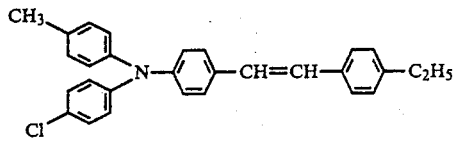
A-99
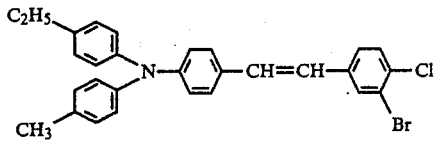
A-100
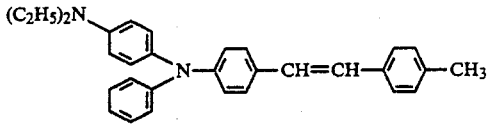
A-101
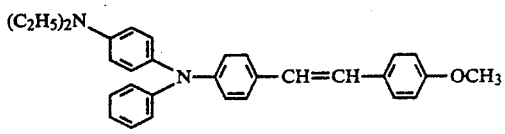
A-102
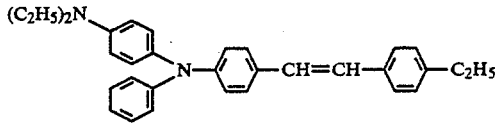
A-103
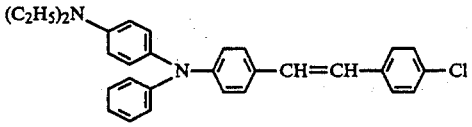
A-104
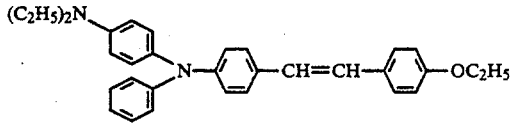
A-105
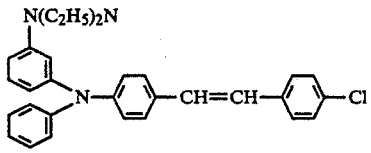
A-106
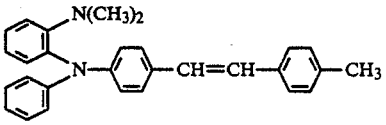
A-107
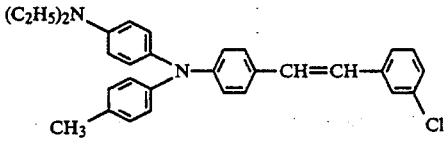
A-108
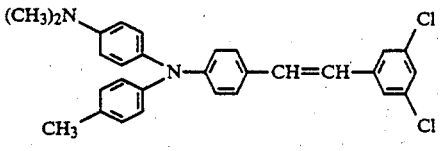
-continued
A-109
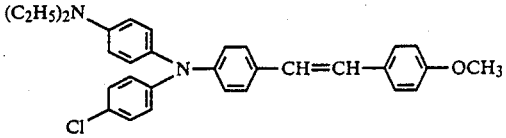
A-110
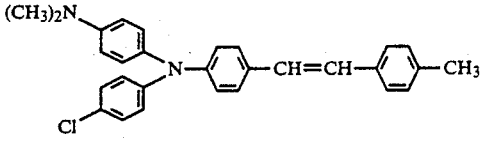
A-111
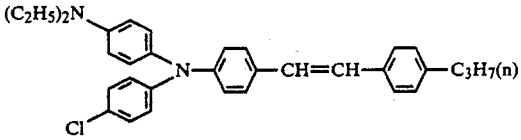
A-112
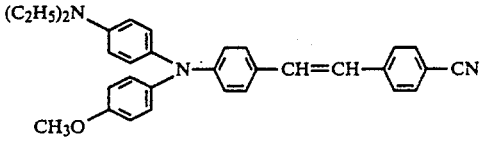
A-113
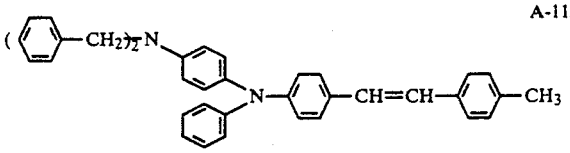
A-114
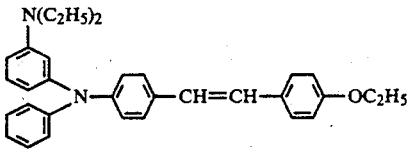
A-115
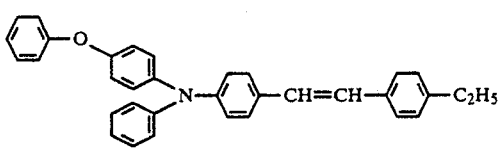
A-116
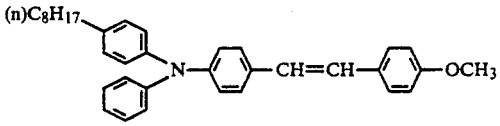
A-117
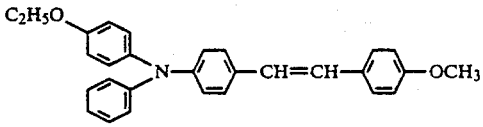
A-118
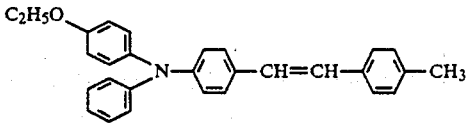
A-119
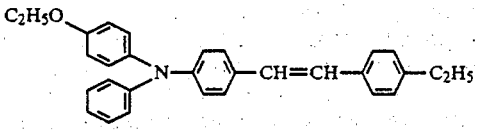

-continued

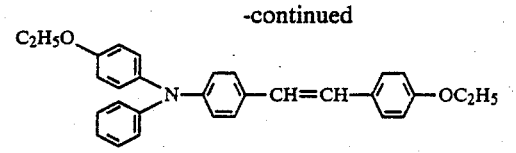

A-120

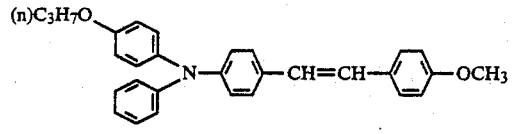

A-121

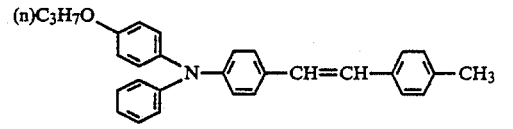

A-122

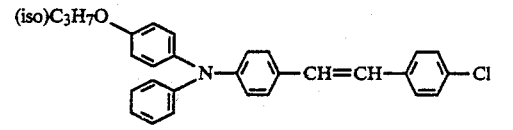

A-123

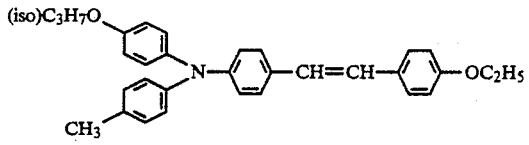

A-124

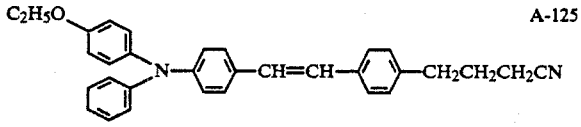

A-125

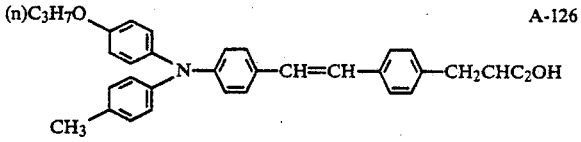

A-126

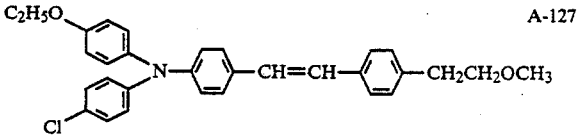

A-127

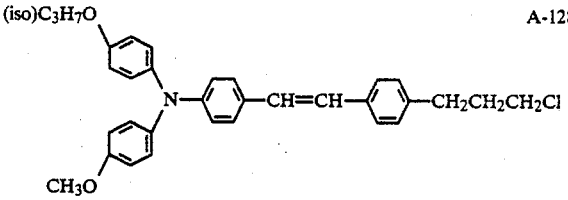

A-128

These carrier transporting substances may also be added into the above carrier generating layer 2, desired. (Namely, at least one of the carrier transporting layer and the carrier generating layer may contain the carrier transporitng substance.)

Also, a binder resin may be also contained in the carrier transporting layer in addition to the carrier transporting substance. The binder resin may be, for example, polyethylene, polypropylene, acrylic resin, methacrylic resin, polycondensation resin and copolymer resin containing two or more of recurring units of these resins such as vinyl chloride-vinyl acetate resin, vinyl chloride-vinyl acetate-maleic anhydride resin, etc. However, the binder resin is not limited to these resins, but all the resins generally employed for such uses can be employed.

It is also possible to incorporate various kinds of additives in the carrier transporting layer for the purpose of improving flexibility, reducing residual potential and reducing fatigue during repeated uses. Such additives may be inclusive of diphenyl, diphenyl chloride, o-terphenyl, p-terphenyl, dibutyl phthalate, dimethylglycol phthalate, dioctyl phthalate, triphenylphosphoric acid, methylnapthalene, benzophenone, chlorinated paraffin, dilaurylthiopropionate, 3,5-dinitrobenzoic acid, various kinds of fluorocarbons, etc.

As for the electroconductive support, a metal plate such as of aluminum or nickel, a metal drum or a metal foil, a plastic film having aluminum, tin oxide or indium oxide vapor deposited thereon or a film or drum of paper or plastic coated with an electroconductive substance may be employed.

Figure 3:
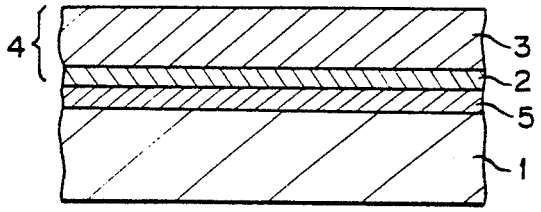
FIG. 3 shows a sectional view of a part of another light-sensitive member.

The light-sensitive member of the present invention may also be constituted as shown in FIG. 3. That is, by providing between the carrier layer and the support 1 an intermediate layer 5 as a sub-layer beneath the carrier generating layer 2, the intermediate layer 5 can be endowed with a function to impede injection of free carriers from the electroconductive support 1 into the light-sensitive layer 4, or it can be endowed with an adhesive layer for adhering the light-sensitive layer 4 integrally to the electroconductive support. The intermediate layer 5 may be made of a material selected from metal oxides such as aluminum oxide, indium oxide and the like, polymeric compounds such as acrylic resin, methacrylic resin, vinyl chloride resin, vinyl acetate resin, epoxy resin, polyurethane resin, phenol resin, polyester resin, alkyd resin, polycarbonate resin, silicone resin, melamine resin, vinyl chloride-vinyl acetate copolymer resin, vinyl chloride-vinyl acetate-maleic anhydride copolymer resin and the like.

In the light-sensitive member as described above, the carrier generating layer 2 is formed by coating of a coating solution containing an azo type pigment to which a minute amount of an amine is added, with a composition having an amine of content of 20 mole or less per viale of the azo type pigment and the solvent and therefore it has a structure which can accomplish sufficiently the object of the present invention.

For formation of such a carrier generating layer, other than employing the coating solution as described above, it is also possible employ a method in which a minute amount (namely 20 mole or less, preferably 10 mole or less, more preferably 5 mole or less per mole of the azo type pigment) of an amine is added into the coating solution during formation of the charge transporting layer, and the amine is permitted to be diffused (during drying of the coating solution) from the coating solution for the carrier transporting layer coated into the lower layer of the crrier generating layer. The amount of the amine thus diffused into the carrier can be controlled to 20 mole or less per mole of the azo type pigment similarly as described above.

Alternatively, after formation of the carrier generating layer, before coating of the carrier transporting layer, the carrier generating layer may be left to stand once in an amine solvent atmosphere for a predetermined period of time thereby attaching an amine on the surface of the carrier generating layer, followed further by diffusion of the amine into the carrier generating layer. Also, according to this method, by controlling the amine atmosphere concentration, the amine diffusion concentration into the carrier generating layer can be controlled to set the amine content within the range as specified above.

Figure 4:
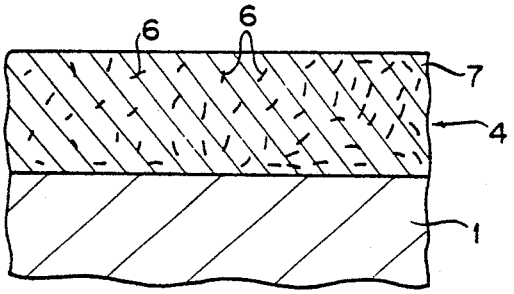
FIG. 4 shows a sectional view of a part of still another light-sensitive member.

FIG. 4 shows an embodiment of a light-sensitive layer 4 comprising two phases in which the particles 6 of the above azo pigment are dispersed in the above carrier transporting substance 7.

In this case, in the light-sensitive layer 4, the carrier generating substance 6 should be contained in an amount of 1 to 200 (desirably 10 to 100) parts by weight per 100 parts by weight of the binder. This is because an amount less than 1 part by weight can give only poor sensitivity, while an amount in excess of 200 parts by weight will worsen the film-forming ability. On the other hand, the amount of the carrier transporting substance should be 10 to 300 (desirably 50 to 200) parts by weight per 100 parts by weight of the binder. This is because an amount less than 10 parts by weight is poor in the effect, while an amount in excess of 300 parts by weight will lower the film-forming ability and charge retaining ability.

Also, in the embodiment of FIG. 4 similarly as in other embodiments as already described, 20 moles or less of an amine per mole of an azo pigment are required to be contained in the phase.

The present invention is described below by referring to Examples.

EXAMPLE 1

On an electroconductive support made of a polyethylene terephthalate with a thickness of 100 μm having aluminum vapor deposited thereon, an intermediate layer of a vinyl chloride-vinyl acetate-maleic anhydrice copolymer "Ethlec MF-10" (produced by Sekisui Kagaku Kogyo Co.) with a thickness of about 0.05 μm was provided. Then, 1.5 g of a bisazo compound represented by the structural formula [I] shown below was dispersed in 100 ml of a mixed dispersing medium of 1,2-dichloroethane/monoethanolamine of a volume ratio of 1000:1 in a ball mill for 8 hours, and the resultant dispersion was applied on the above intermediate layer, followed by sufficient drying, to form a carrier generating layer with a thickness of about 0.3 μm.

Structural formula [I]:

Structural formula [I]

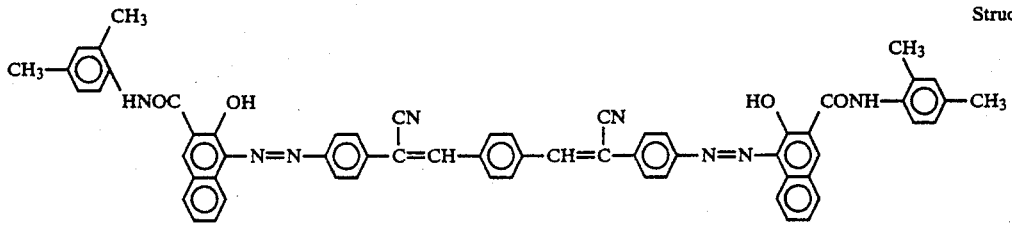

On the other hand, 11.25 g of a styryl compound represented by the structural formula [II] shown below and 15 g of a polycarbonate resin "Panlite L-1250" (produced by Teijin Kasei Co.) were dissolved in 100 ml of 1,2-dichloroethane, and the resultant solution was applied on the above carrier generating layer, followed by sufficient drying, to form a carrier transporting layer with a thickness of 15 μm, thus preparing an electrophotographic light-sensitive member based on the present invention. This is called as "Sample 1".

Structural formula [II]

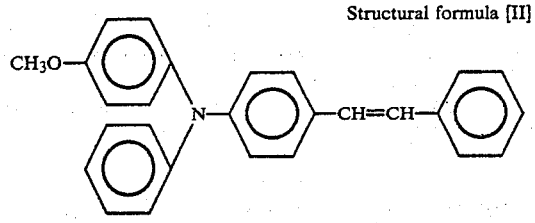

EXAMPLES 2 TO 7

Example 1 was repeated except for changing ratio of 1,2-dichloroethane/monoethanolamine as the dispersing medium for coating to 60:1, 110:1, 200:1, 500:1, 5000:1 and 10000:1, respectively, in formation of the carrier generating layer, to prepare 6 kinds of electrophotographic light-sensitive members based on the present invention. These are called as "Sample 2", "Sample 3", "Sample 4", "Sample 5", "Sample 6" and "Sample 7", respectively.

EXAMPLES 8 TO 11

Example 1 was repeated except for employing as the dispersing medium for coating of the bisazo compound, mixed dispersing media at a volume ratio of 500:1 of 2-dichloroethane/ethylenediamine, 1,2-dichloroethane/piperidine, 1,2-dichloroethane/dietylamine and 1,2-dichloroethane/triethanolamine in formation of the carrier generating layer to prepare 4 kinds of the electrophotographic light-sensitive members based on the present invention. These are called as "Sample 8", "Sample 9", "Sample 10" and "Sample 10", respectively.

COMPARATIVE EXAMPLES 1 TO 3

Example 1 was repeated except for employing as the dispersing medium for coating of the bisazo compound, dispersing media 1,2-dichloroethane, monoethanolamine and a mixed dispersing medium at a volume ratio of 50:1 of 2-dichloroethane/monethanolamine in formation of the carrier generating layer to prepare 3 kinds of electrophotographic light-sensitive members for comparative purpose. These are called as "Comparative sample 1", "Comparative sample 2" and "Comparative sample 3", respectively.

EXAMPLE 12

An electrophotographic light-sensitive member based on the present invention was prepared according to entirely the same procedure as in Example 1 except for substituting a trisazo compound represented by the structural formula [III] shown below for charge generating substance of the bisazo compound [I] in formation of the carrier generating layer and substituting a hydrazone compound represented by the structural formula

[IV] for the charge transporting substance of the styryl compound [II] in formation of the carrier transporting layer. This is called as "Sample 12".

Structural formula [III]

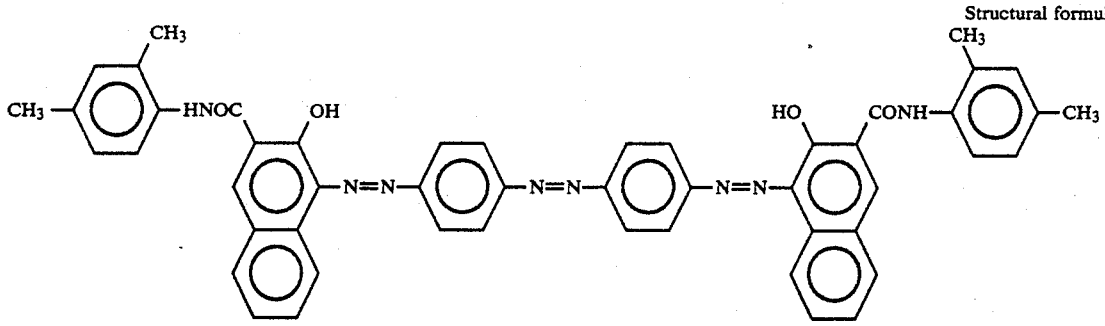

Structural formula [IV]

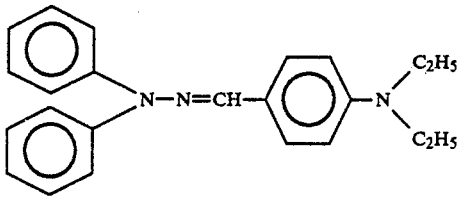

EXAMPLEs 13 TO 18

Example 12 was repeated except that the volume ratio of 1,2-dichloroethane/monoethanolamine as the mixed dispersing medium for coating of the trisazo compound was changed to 50:1, 100:1, 200:1, 500:1, 5000:1 and 10000:1, respectively, in formation of the carrier generating layer to prepare 6 kinds of electrophotographic light-sensitive members based on the present invention. These are called as "Sample 13", "Sample 14", "Sample 15", "Sample 16", "Sample 17" and "Sample 18", respectively.

COMPARATIVE EXAMPLES 4 TO 6

Example 12 was repeated except that, as the mixed dispersing medium for coating of the trisazo compound, 1,2-dichloroethane, monoethanol amine and a mixed dispersing medium of 1,2-dichloroethane/monoethanolamine at a volume ratio of 25:1 were employed, respectively, in formation of the carrier generating layer to prepare 3 kinds of electrophotographic light-sensitive members. These are called as "Comparative sample 4", "Comparative sample 4" and "Comparative sample 5", respectively.

EXAMPLE 19

On an electroconductive support made of a polyethylene terephthalate with a thickness of 100 μm having aluminum vapor deposited thereon, an intermediate layer of a vinyl chloride-vinyl acetate-maleic anhydrice copolymer "Ethlec MF-10" (produced by Sekisui Kagaku Kogyo Co.) with a thickness of about 0.05 μm was provided. Then, 1.5 g of a bisazo compound represented by the structural formula [V] shown below was dispersed in 100 ml of 1,2-dichloroethane in a ball mill for 8 hours, and the resultant dispersion was applied on the above intermediate layer, followed by sufficient drying, to form a carrier generating layer with a thickness of about 0.3 μm.

On the other hand, 11.25 g of a styryl compound represented by the structural formula [VI] shown below and 15 g of a polycarbonate resin "Panlite L-1250" (produced by Teijin Kasei Co.) were dissolved in 100 ml of a mixture of 1,2-dichloroethane/monoehanolamine at a volume ratio of 1000/1, and the resulstant solution was applied on the above carrier generating layer, followed by sufficient drying, to form a carrier transporting layer with a thickness of 10 μm, thus preparing an electrophotographic light-sensitive member based on the present invention. This is called as "Sample 19".

Structural formula [V]

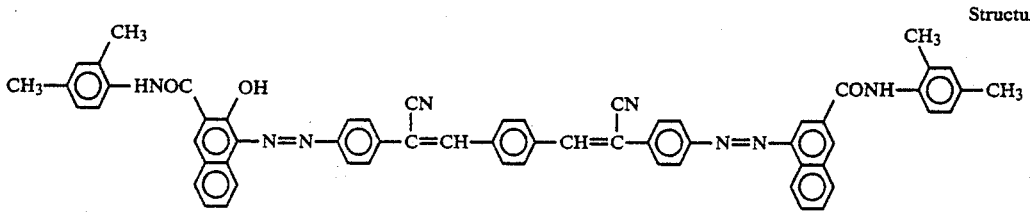

Structural formula [VI]

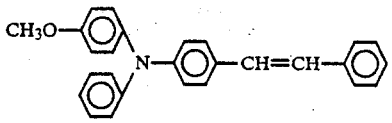

EXAMPLE 20

A carrier genearting layer was formed in the same manner as in Example 19, and the carrier generating layer was left to stand in a vapor of monoethanolamine at 120° C. for 5 minutes to treat the carrier generating layer- with this vapor, whereby monoethanolamine was diffused into the carrier generating layer. On the other hand, a carrier transporting layer was formed similarly as in Example 1 to prepare an electrophotographic light-sensitive member based on the present invention. This is called as "Sample 20".

EXAMPLE 21

In formation of the carrier generating layer, Example 1 was repeated except for employing a bisazo compound represented by the structural formula [VII] shown below to provide a carrier generating layer thickness of 0.5 μm. On the other hand, in formation of the carrier transporting layer, Example 1 was repeated except for employing a carrier transporting substance of a hydrazone compound represented by the structural formula [VIII] shown below to form a carrier transporting layer with a thickness of 15 μm on the above carrier generating layer, thus preparing an electrophotographic light-sensitive member based on the present invention. This is called as "Sample 21".

COMPARATIVE EXAMPLE 7

An electrophotographic light-sensitive member for comparative purpose was prepared according to entirely the same procedure as in Example 21 except for using 1,2-dichloroethane as the coating solvent for the bisazo compound. This is called as "Comparative sample 7".

EXAMPLE 22

In formation of the carrier generating layer, Example 1 was repeated except for employing a bisazo compound represented by the structural formula [IX] shown below to provide a carrier generating layer with a thickness of 0.5 μm. On the other hand, in formation of the carrier transporting layer, Example 1 was repeated except for employing a carrier transporting substance of a hydrazone compound represented by the structural formula [X] shown below to form a carrier transporting layer with a thickness of 15 μm on the above carrier generating layer, thus preparing an electrophotographic light-sensitive member based on the present invention. This is called as "Sample 22".

Structural formula

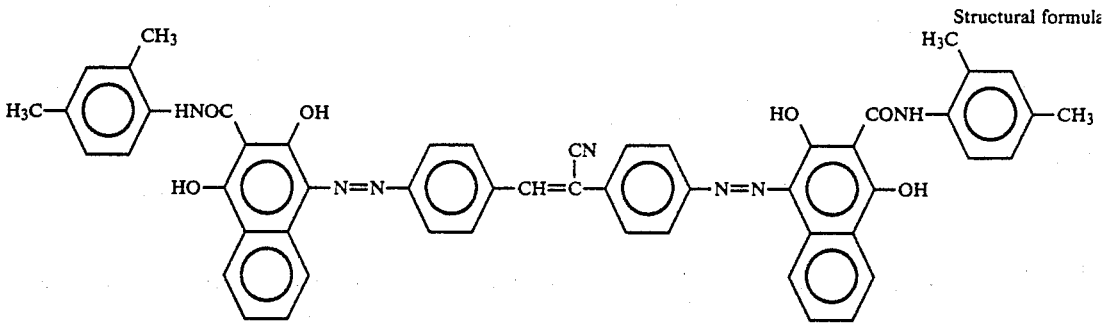

Structural formul

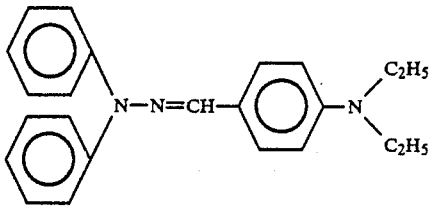

COMPARATIVE EXMPLE 8

An electrophotographic light-sensitive member was prepared in enirely the same manner as in Example 22 except for using 1,2-dichloroethane as the solvent for coating of the bisazo compound in formation of the Structural formula [VII]

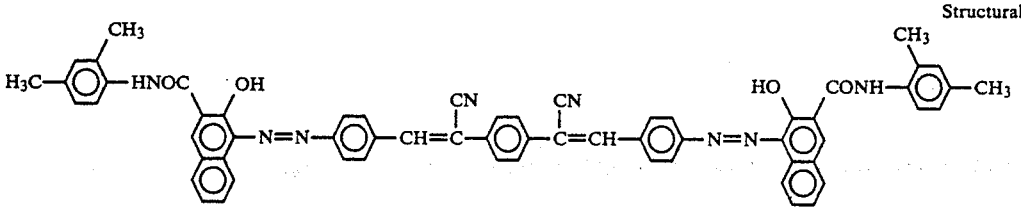

Structural formula [VIII]

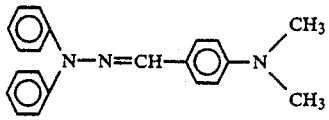

carrier generating layer. This is called as "Comparative sample No. 8".

EXAMPLE 23

In formation of the carrier generating layer, Example 1 was repeated except for employing a bisazo compound represented by the structural formula [XL] shown below to provide a carrier generating layer with a thickness of 0.5 μm. On the other hand, in formation of the carrier transporting layer, Example 1 was repeated except for employing a carrier transporting substance of a styryl compound represented by the structural formula [XLL] shown below to form a carrier transporting layer with a thickness of 15 μm the above carrier generating layer, thus preparing an electrophotographic light-sensitive member based on the present invention. This is called as "Sample 22".

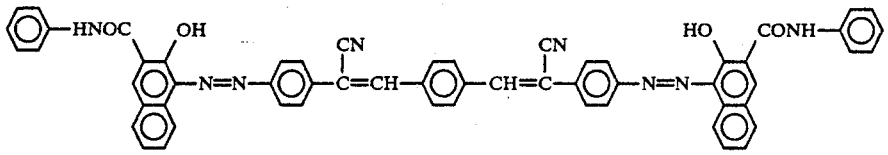

Structural formula [XI]

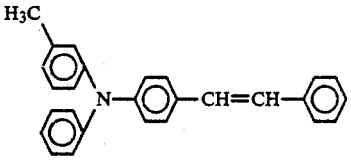

Structural formula [XII]

COMPARATIVE EXAMPLE 9

An electrophotographic light-sensitive member was prepared in entirely the same manner as in Example 23 except for using 1,2-dichloroethane as the solvent for coating of the bisazo compound in formation of the carrier generating layer. This called as "Comparative sample No. 9".

For each of the electrophotographic light-sensitive members as prepared above (Samples 1 to 20 and Comparative samples 1 to 6), its electrophotographic characteristics were examined by means of "Electrometer SP-428 Model" (produced by Kawaguchi Denki Seisakusho). More specifically, the acceptive potential $V_A$(V) when the surface of the light-sensitive member was charged to −6 KV for 5 seconds, the potential $V_I$ (initial potential) after dark decay for 5 seconds, the exposure dosage E ½ (lux.sec) necessary for decay to ½, the dark decay percentage $(V_a-V_I)/V_I\times 100$ (%) and further the exposure dosage $E_{50}^{500}$ lux.sec) necessary for decay of the initial potential ($V_I$) from −500 (V) to −50 (V) were measured. Results are shown in the following Table 1.

TABLE 1

| Electrophotographic light-sensitive member | Amine* content (mole) | $V_{A(V)}$ | E ½ (lux sec) | Dark decay (%) | $E_{50}^{500}$ (lux · sec) |
|---|---|---|---|---|---|
| Sample 1 | 1.1 | −1010 | 1.9 | 12 | 4.0 |
| Sample 2 | 18.0 | −1100 | 2.8 | 8 | 6.0 |
| Sample 3 | 9.8 | −1080 | 2.5 | 9 | 5.2 |
| Sample 4 | 5.4 | −1050 | 2.0 | 10 | 4.4 |
| Sample 5 | 2.2 | −1030 | 2.0 | 11 | 4.0 |
| Sample 6 | 0.2 | −910 | 1.9 | 16 | 3.8 |
| Sample 7 | 0.1 | −840 | 1.8 | 18 | 3.7 |
| Sample 8 | 1.9 | −1030 | 2.0 | 11 | 4.3 |

TABLE 1-continued

| Electrophotographic light-sensitive member | Amine* content (mole) | $V_{A(V)}$ | E ½ (lux sec) | Dark decay (%) | $E_{50}^{500}$ (lux · sec) |
|---|---|---|---|---|---|
| Sample 9 | 1.3 | −920 | 1.9 | 16 | 3.9 |
| Sample 10 | 1.3 | −1020 | 1.7 | 18 | 3.8 |
| Sample 11 | 1.0 | −1070 | 2.0 | 8 | 4.8 |
| Sample 19 | 1.1 | −960 | 2.0 | 13 | 4.1 |
| Sample 20 | 1.1 | −1050 | 2.1 | 10 | 4.5 |
| Comparative sample 1 | — | −720 | 2.0 | 22 | 4.9 |
| Comparative sample 2 | — | −1210 | 8.7 | 5 | 37 |
| Comparative sample 3 | 21.5 | −1130 | 3.2 | 7 | 11.0 |
| Sample 12 | 0.9 | −900 | 1.8 | 16 | 4.2 |
| Sample 13 | 18.2 | −1000 | 2.9 | 9 | 6.3 |
| Sample 14 | 9.1 | −990 | 2.6 | 11 | 4.8 |
| Sample 15 | 4.6 | −950 | 2.1 | 13 | 4.4 |
| Sample 16 | 1.8 | −910 | 1.9 | 15 | 4.3 |
| Sample 17 | 0.2 | −880 | 1.8 | 18 | 4.2 |
| Sample 18 | 0.1 | −850 | 1.7 | 18 | 4.3 |
| Comparative sample 4 | — | −780 | 1.6 | 30 | 4.5 |
| Comparative sample 5 | — | −1050 | 3.8 | 7 | 12.0 |
| Comparative sample 6 | 22.0 | −1010 | 3.0 | 8 | 8.9 |
| Sample 21 | 1.1 | −890 | 2.2 | 17 | 5.2 |
| Sample 22 | 1.3 | −935 | 2.1 | 14 | 4.0 |
| Sample 23 | 1.2 | −980 | 2.0 | 12 | 4.1 |
| Comparative sample 7 | — | −765 | 3.5 | 32 | 7.0 |
| Comparative sample 8 | — | −725 | 3.0 | 35 | 6.9 |
| Comparative sample 9 | — | −795 | 2.1 | 26 | 5.2 |

*In Table 1, amine content refers to moles of the amine per mole the charge generating substance.

From the results shown in Table 1, it can clearly be seen that by restricting the amine content in the charge generating layer to 20 moles or less, particularly 10 moles or less (further 5 moles or less) per mole of the charge generating substance and the solvent based on the present inventon, light sensitivity as well as other electrophotographic characteristics such as dark decay can be greatly improved.

We claim:

1. A light-sensitive member having a charge generating phase formed by coating a dispersion comprising a solvent and a charge generating substance having an electron attracting group dispersed therein, which contains in said charge generating phase an amine as a material which increases light sensitivity in an amount of 20-fold moles or less per mole of said charge generating substance and 1/60 or less by volume of said solvent.

2. The light-sensitive member according to claim 1, wherein said amine is contained in an amount of 5-fold moles or less of said charge generating substance.

3. The light-sensitive member according to claim 1, wherein said amine has a molecular weight of 150 or less and a basicity ($K_B$) of $10^{-12}$ or more.

4. The light-sensitive memeber according to claim 1, wherein said amine is selected from the group consisting of monoethanolamine, n-butylamine, ethylenediamine, diethanolamine, diethylamine, di-n-propylamine, triethanolamine, triethylamine, pyridine and piperidine.

5. The light-sensitive member according to claim 1, wherein said charge generating substance comprises an azo type pigment.

6. The light-sensitive member according to claim 5, wherein said charge generating substance contains a binder resin in an amount of 0 to 100 % by weight based on the azo type pigment.

7. The light-sensitive member according to claim 1, wherein said charge generating phase is a charge generating layer having thickness of 0.05 to 10 μm.

8. The light-sensitive member according to claim 7, wherein a charge transporting layer is formed on the charge generating layer; at least one of said charge transporting layer and said charge generating layer containing a charge transporting substance selected from the group consisting of styryl compounds, hydrazone compounds, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, pyrazoline derivatives, oxazolone derivatives, benzothiazole derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-9-vinylanthracene, 2,4,7-trinitrofluorenone, 2,4,5,7-tetra-nitrofluorenone and 2,7-dinitrofluorenone.

9. The light-sensitive member according to claim 8, wherein an intermediate layer is provided between the charge generating layer and a support, said intermediate layer comprising a material selected from the group consisting of aluminum oxide, indium oxide, acrylic resin, methacrylic resin, vinyl chloride resin, vinyl acetate resin, epoxy resin, polyurethane resin, phenol resin, polyester resin, alkyd resin, polycarbonate resin, silicone resin, melamine resin, vinyl chloride - vinyl acetate copolymer resin and vinyl chloride - vinyl acetate - maleic anhydride copolymer resin.

10. A method for preparing a light-sensitive member having a charge generating phase containing a charge generating substance having an electron attracting grout dispersed therein, which comprises: a step of adding an amine in an amount of 20-fold moles or less per mole of said charge generating substance into a solvent for coating of said charge generating phase, said amine being an agent which increases light sensitivity, said amine being present in an amount of 1/60 or less by volume of said solvent, and dispersing said charge generating substance in the coating solvent; and a step of forming said charge generating phase by coating of the resultant dispersion.

11. The method according to claim 10 wherein the amine is added into the coating solvent in an amount of 5-fold moles or less of the charge generating substance.

12. The method according to claim 10 wherein the amine has a molecular weight of 150 or less and a basicity of $10^{-12}$ or more.

13. The method according to claim 10, wherein the amine has a higher boiling point than that of the solvent for coating of the charge generating phase or a charge transporting phase being in contact with the charge generating phase.

14. The method according to claim 13, wherein the drying temperature after coating of a coating solution for the charge generating phase or the charge transporting phase is made lower than the boiling point of the amine.

15. The method according to claim 10, wherein an azo type pigment is used as the charge generating substance.

16. A method for preparing a light-sensitive member having a charge generating layer containing a charge generating substance having an electron attracting group and a charge transporting layer which is in contact with the charge generating layer and contains a charge transporting substance, which comprises: a step of adding an amine in an amount of 20-fold moles or less per mole of said charge generating substance into a solvent for coating of said charge transporting layer, said amine being an agent which increases light sensitivity, the amount of said amine being 1/60 or less by volume of said solvent, and dissolving said charge transporting substance in the coating solvent, and a step of forming said charge transporting layer by coating of the resultant solution.

17. The method according to claim 16, wherein the amine is added into the coating solvent in an amount of 5-fold moles or less of the charge generating substance.

18. The method according to claim 16 wherein the amine has a molecular weight of 150 or less and a basicity of $10^{-12}$ or more.

19. The method according to claim 16, wherein the amine has a higher boiling point than that of the solvent for coating of the charge generating layer or the charge transporting layer.

20. The method according to claim 16, wherein the drying temperature after coating of a coating solution for the charge generating layer or the charge transporting layer is made lower than the boiling point of the amine.

21. The method according to claim 16, wherein an azo type pigment is used as the charge generating substance.

22. The method according to claim 17, wherein the amine has a molecular weight of 150 or less and a basicity of $10^{-12}$ or more.

* * * * *